United States Patent [19]

Saijo

[11] Patent Number: 4,891,679

[45] Date of Patent: Jan. 2, 1990

[54] CLEANING APPARATUS FOR AN IMAGE FORMING MACHINE

[75] Inventor: Hiromitsu Saijo, Osaka, Japan

[73] Assignee: Minolta Camera Kabushiki Kaisha, Osaka, Japan

[21] Appl. No.: 278,725

[22] Filed: Dec. 2, 1988

[30] Foreign Application Priority Data

Dec. 4, 1987 [JP] Japan ..... 62-307955

[51] Int. Cl.[4] ..... G03G 15/00; G03G 15/08

[52] U.S. Cl. ..... 355/298; 355/296; 355/299

[58] Field of Search ..... 355/296, 298, 299, 304, 355/307, 269

[56] References Cited

U.S. PATENT DOCUMENTS

| | | | |
|---|---|---|---|
| 4,131,359 | 12/1978 | Honda | 355/299 X |
| 4,158,498 | 6/1979 | Ohmori | 355/299 |
| 4,627,716 | 12/1986 | Oka | 355/298 |
| 4,674,865 | 6/1987 | Tada et al. | 355/298 X |
| 4,711,561 | 12/1987 | Tsuruoka | 355/298 |
| 4,730,205 | 3/1988 | Ogiri et al. | 355/298 |
| 4,806,981 | 2/1989 | Ishiguro et al. | 355/298 |

FOREIGN PATENT DOCUMENTS

| | | |
|---|---|---|
| 58-181081 | 10/1983 | Japan . |
| 59-111173 | 6/1984 | Japan . |

*Primary Examiner*—A. C. Prescott

*Attorney, Agent, or Firm*—Burns, Doane, Swecker & Mathis

[57] ABSTRACT

An improved cleaning apparatus for removing toner particles remaining on an electrostatic latent image bearing member which is so arranged to include a first removing device for removing the toner particles by contacting the surface of the electrostatic latent image bearing member, a rotatable collecting member to collect the removed toner particles, an accommodating member disposed adjacent to said rotatable collecting member, a second removing device for removing the toner paticles from the surface of the rotatable collecting member and for guiding the toner particles into the accommodating device, and a supply member for supplying non-volatile material onto the rotatable collecting member wherein said non-volatile material has an affinity for the toner particles.

10 Claims, 2 Drawing Sheets

CLEANING APPARATUS FOR AN IMAGE FORMING MACHINE

BACKGROUND OF THE INVENTION

Conventional image forming machines such as powder image transfer-type electrophotographic copy machines and the like variously provide devices for removing residual toner from the surface of the powder image carrying member.

The most typical of these devices is the so-called blade cleaning device which has seen wide application as a device configured to bring a flexible blade into contact with the surface of the powder image carrying member so as to scrape off developer in conjunction with the movement of said powder image carrying member.

However, in this type of device, the removed toner is a natural powder. Toner in the aggregate state contains approximately 60 to 70% air under normal conditions, while the aggregate itself is comprised of only about 30 to 40% of toner particles. This circumstance is, therefore, an obstacle to down-sizing the entire device.

To eliminate the aforesaid disadvantage, the removed toner is heated and solidified or liquified to condense its volume, thereby allowing the entire device to be designed so as to be more compact.

For example, Japanese Laid-Open Patent Application No. 58-181081 discloses an apparatus having a collection box for collecting the removed toner and provided with a heater to solidify said removed toner.

However, the aforesaid type of device requires a heating means, which not only creates extremely large power consumption for the entire copy machine, but also readily produces adverse effects on other units within said copy machine. That is, the electrical substrate and latent image carrying member (for example, an organic photosensitive member) are extremely sensitive to heat and are generally arranged in the vicinity of the cleaning apparatus.

Japanese Laid-Open Patent Application No. 59-111173 discloses a device wherein the removed toner is guided into a waste developer recovery vessel for holding said removed toner, and said removed toner being collected in an adsorbent, non-volatile liquid.

The aforesaid type of device differs from that disclosed in Japanese Laid-Open Patent Application No. 58-181081 in that the various disadvantages arising from the application of heat are lacking.

However, in the device disclosed in Japanese Laid-Open Patent Application No. 59-111173, a disadvantage arises in that the removed toner must be guided into the recovery vessel wherein it accumulates in the non-volatile liquid, and the transport device which accomplishes said guidance inevitably leads to enlargement of the apparatus.

The greatest disadvantage is the reduced adsorption of the non-volatile liquid which occurs after the removed toner is adsorbed. In the device disclosed in Japanese Laid-Open Patent Application No. 59-111173, felt or a similar material is impregnated with the aforesaid liquid and once the removed toner is adsorbed by the entire surface of said felt, no further toner adsorption is possible. Further, the adsorptivity of said non-volatile liquid is rapidly reduced by the impurity of said liquid which results from its accumulation alone. The use of such a device also enlarges the size of the entire apparatus.

SUMMARY OF THE INVENTION

The present invention overcomes and eliminates the aforesaid disadvantages.

A first object of the present invention is to provide a new standard of cleaning apparatus for use in image forming machines such as powder image transfer-type electrophotographic copy machines.

A second object of the present invention is to provide a cleaning apparatus which does not affect other units within the image forming apparatus.

A third object of the present invention is to provide a cleaning apparatus that collects removed toner by means of adsorption by non-volatile liquid and which allows for downsizing the entire apparatus.

A fourth object of the present invention is to provide a cleaning apparatus that collects removed toner by means of adsorption by a non-volatile liquid, and which is capable of collecting said removed toner by fresh non-volatile liquid.

The present invention accomplishes the aforesaid objects by means of a cleaning apparatus for removing toner particles remaining on an electrostatic latent image bearing member which is so arranged to include a first removing device for removing the toner particles by contacting the surface of the electrostatic latent image bearing member, a rotatable collecting member to collect the removed toner paricles, an accomodating member disposed adjacent to said rotatable collecting member, a second removing device for removing the toner particles from the surface of the rotatable collecting member and for guiding the toner particles into the accomodating member, and a supply device for supplying non-volatile material on the rotatable collecting member wherein said non-volatile material has an affinity for the toner particles.

BRIEF DESCRIPTION OF THE DRAWINGS

These and other objects or features of the present invention will become apparent from the following description of a preferred embodiment(s) thereof taken in conjunction with the accompanying drawings, in which.

In the following description, like parts are designated by like reference numbers throughout the several drawings.

DESCRIPTION OF THE PREFERRED EMBODIMENT

1. First Embodiment

Figure 1:
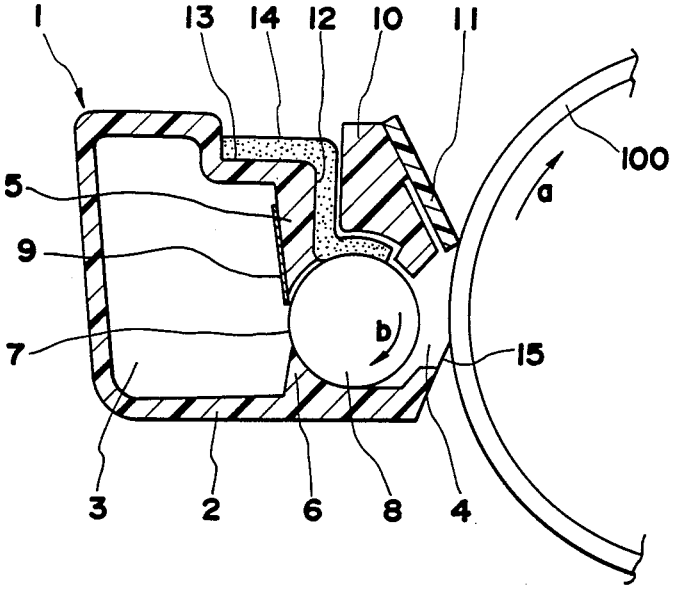
FIG. 1 is a schematic cross-sectional view of the cleaning apparatus of the present invention for use in an image forming machine.

FIG. 1 shows the first embodiment of the present invention. In cleaning apparatus 1, a toner hopper 3 is disposed on the posterior portion of casing 2 (the side opposite the photosensitive drum 100), while at the anterior portion is disposed toner recovery portion 4, and both are connected via opening 7 provided medially between top partition 5 and bottom partition 6.

A recovery roller 8 is provided at toner recovery portion 4 opposite opening 7, said recovery roller 8 being rotatable in the direction of arrow "b," and a bottom partition 6 disposed opposite said recovery roller 8 is arranged parallel to the outer periphery of said roller 8 with a small gap provided therebetween.

At the back of top partition 5 is provided a scraper 9, the leading edge of which extends into opening 7 so as to make contact with the circumferential surface of recovery roller 8. Further, a toner spill-inhibiting member 15 is disposed at the front of casing 2.

A removable cover 10 is mounted above toner recovery portion 4, the front of said cover 10 having a blade 11 affixed thereto with the leading edge of said blade 11 pressing against the peripheral surface of photosensitive drum 100.

In addition, an air space 12 and an externally facing stepped portion 13 are provided medially between said cover 10, casing 2 and recovery roller 8. The aforesaid air space 12 and stepped portion 13 have a porous material 14 provided thereto, and said porous material 14 incorporates therein a non-volatile material having an affinity for said toner.

Sponge or non-woven fabric or the like may be used as the aforesaid porous material 14. In the case wherin the cleaning apparatus is disposed adjacent to a fixing device, a material having a boiling point of 200° C. or greater is desirable for use as the non-volatile material, for example, silicone oil, motor oil, spindle oil, grease, resin grease or the like.

In cleaning apparatus 1 constructed as shown in FIG. 1, the aforesaid non-volatile material is poured into said apparatus from stepped portion 13 to impregnate porous material 14, or said porous material 14 may be pre-impregnated with said non-volatile material and thereafter set medially between cover 10 and casing 1. The former method produces less soiling of the surroundings by said non-volatile material than does the latter method.—

In a cleaning apparatus of the aforesaid construction, toner which still adheres to the surface of photosensitive drum 100 which has already passed the transfer portion is scraped off said surface by blade 11 via the rotation of said photosensitive drum 100, said removed toner then falling into recovery portion 4. The removed toner cannot leak to the exterior of the machine because the space between the casing 2 and photosensitive drum 100 is shielded by the toner spill-inhibiting member 15.

On the other hand, recovery roller 8 rotates in the direction of arrow "b," such that the surface thereof is thinly coated with non-volatile material as said surface rubs against the porous material 14.

Accordingly, the toner collected in toner recovery portion 4 adheres to the surface of the recovery roller 8 through the non-volatile material, and is transported to opening 7 by means of the rotation of said roller 8, whereupon the toner is scraped off the surface of roller 8 by scraper 9 and collected in accommodating portion 3. Since recovery roller 8 and bottom partition 6 have a small gap provided therebetween, the toner remaining on said roller 8 passes through that portion without any disturbance whatsoever.

The surface of recovery roller 8 which has passed the portion opposite scraper 9 is again supplied with non-volatile material at the portion opposite the porous material 14.

Toner collected in toner hopper 3 is mixed with non-volatile material, and said non-volatile material is introduced between the toner particles thereby reducing the space between said toner particles by inducing a surface tension.

Thus, the volume of the toner with added non-volatile material is reduced to less than that of the aggregate toner alone by a one-stage process.

More specifically, when 30 cc of silicone oil is dripped into 110 cc of powder toner maintained in a normal state, the combined volume of the mixture is reduced to 60 cc, i.e., the toner volume is reduced approximately 55%. Further, when 5 g of toner [volume conversion: 15 cc] is added to the aforesaid toner impregnated with silicone oil, said toner is also moderately permeated by said silicone oil; and when even more toner is added thereto, the oil still retains the ability to penetrate between the toner particles.

Accordingly, in the cleaning apparatus of the aforesaid construction, at least double the volume of powder toner can be stored within accommodating portion 3.

2. Second Embodiment

Figure 2:
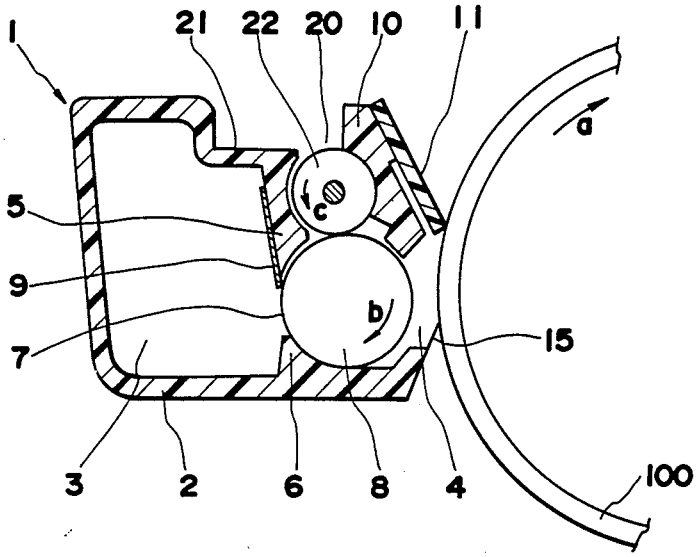
FIGS. 2, 3 and 4 are schematic cross-sectional views of the construction of FIG. 1, showing various modifications.

FIG. 2 shows a second embodiment of the present invention.

Cleaning apparatus 1 of the second embodiment provides a a space 20 formed by casing 2 and cover 10, wherein a spreader roller 22 is disposed which is rotatably driven via contact with recovery roller 8, the exterior surface of said spreader roller 22 maintaining a non-volatile material stored in stepped portion 21 so as to apply said non-volatile material to the exterior surface of the aforesaid recovery roller 8.

The aforesaid spreader roller 22 may also be independently rotatably driven in a state of non-contact with recovery roller 8 and with a small space maintained therebetween.

3. Third Embodiment

Figure 3:
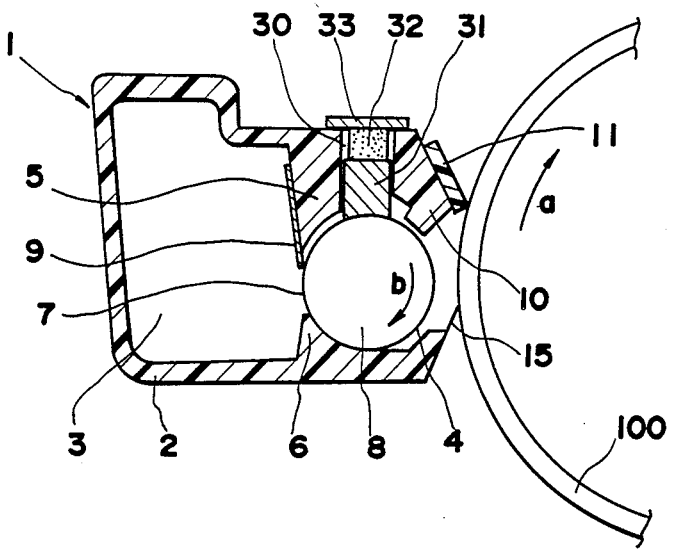

FIG. 3 shows a third embodiment of the present invention.

The cleaning apparatus 1 of the third embodiment uses a fatty acid having a low melting point and which is a solid at room temperature as the non-volatile material, examples of said fatty acid being lauric acid, stearic acid, myristic acid, palmitic acid and the like. Cleaning apparatus 1 of the third embodiment provides a space 30 formed by casing 2 and cover 10, wherein the aforesaid fatty acid 31 is encapsulated so as to be in contact with recovery roller 8, and a sponge 32 is interposed between said fatty acid 31 and a cap 33 which covers the air space. The aforesaid fatty acid 31 is pressed against the exterior surface of recovery roller 8, thereby applying said fatty acid 31 to the surface of said recovery roller 8 via the rotation of said roller.

The cleaning apparatus 1 which uses the fatty acid 31 operates effectively when a fixing device (not shown in the drawing) is mounted adjacent to said cleaning apparatus. Recovered toner is stored in the accommodating portion 3 together with the fatty acid 31, and said fatty acid 31 penetrates between the powder toner particles when melted by heat from the aforesaid fixing device, thereby reducing the volume of said toner in the manner previously described.

4. Fourth Embodiment

Figure 4:
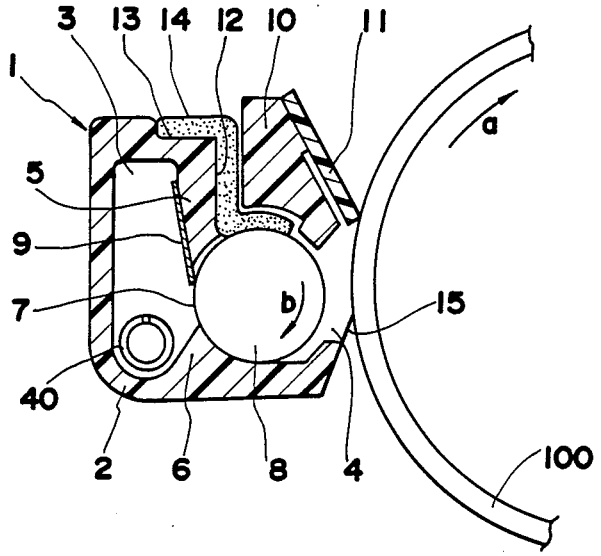

FIG. 4 shows a fourth embodiment of the present invention.

In the fourth embodiment, a transport coil 40 or conveyor transport means is provided in accommodating portion 3, so as to supply the recovered toner to a recovery bottle or the like via a transport path not shown in the drawing.

Since the toner is not maintained as a toner powder alone but rather mixed with a non-volatile material, it can be readily transported by transport coil 40 or the like, even via the low speed rotation of said coil. Further, when the recovery bottle is removed causing oscillation of the transport path, the toner does not splatter in the atmosphere thereby avoiding soiling the operator's hands or clothing, and has a low probability of spilling because it is mixed with the aforesaid non-volatile material.

In the present embodiment of cleaning apparatus 1, the recovery roller 8 is rotatable in the clockwise direction in the drawing, but to allow rotation of said recovery roller 8 in the counterclockwise direction in the drawing the scraper 9 may be disposed at the bottom partition 6 and the non-volatile material may be supplied to the bottom of said recovery roller 8.

The non-volatile material described in the aforesaid first through third embodiments is not limited to those materials described in the various embodiments, but may encompass many non-volatile materials which have an affinity for the aforesaid toner.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cleaning apparatus for removing toner particles remaining on an electrostatic latent image bearing member, said cleaning apparatus comprising:

first removing means for removing the toner particles by contacting the surface of the electrostatic latent image bearing member;

a rotatable collecting member to collect the removed toner particles;

an accommodating means for accommodating the removed toner particles disposed adjacent to said rotatable collecting member;

second removing means for removing the toner particles from the surface of the rotatable collecting member and for guiding the toner particles into the accommodating means;

supply means for supplying non-volatile material onto the rotatable collecting member wherein said non-volatile material has an affinity for the toner particles, said supply means is so disposed upstream of the location where the removed toner particles are collected by the collecting member and downstream of the location where the second removing means makes contact with the rotatable collecting member with respect to the rotating direction of the rotatable collecting member.

2. A cleaning apparatus as claimed in claim 1, wherein said supply means is made of a porous material containing said non-volatile material.

3. A cleaning apparatus as claimed in claim 2, wherein said porous material is sponge or non-woven fabric.

4. A cleaning apparatus as claimed in claim 1, wherein said supply means includes a roller rotatably driven through contact with said rotatable collecting member and a storing member for storing said non-volatile material so as to apply said non-volatile material to the surface of said roller.

5. A cleaning apparatus as claimed in claim 1, wherein said supply means includes a roller independently rotatably driven in a state of non-contact with said rotatable collecting member with a small space maintained therebetween and a storing member for storing said non-volatile material so as to apply said non-volatile material to the surface of said roller.

6. A cleaning apparatus as claimed in claim 1, wherein said non-volatile material is fatty acid which is solid at room temperature.

7. A cleaning apparatus as claimed in claim 6, wherein said fatty acid is selected from the group consisting of lauric acid, stearic acid, myristic acid and palmitic acid or any two or more in combination thereof.

8. A cleaning apparatus as claimed in claim 1, wherein said non-volatile material is non-volatile solvent.

9. A cleaning apparatus as claimed in claim 8, wherein said non-volatile solvent is selected from the group consisting of silicon oil, grease and spindle oil or any two or more in combination thereof.

10. A cleaning apparatus as claimed in claim 1, wherein said accommodating means includes a storage portion for storing the toner removed from said rotatable collecting member and transporting means for transporting the stored toner from said storage portion to the outer side of said storage portion.

* * * * *